US005304799A

United States Patent [19]

Kurzweg

[11] Patent Number: 5,304,799

[45] Date of Patent: Apr. 19, 1994

[54] CYCLOIDAL MASS SPECTROMETER AND IONIZER FOR USE THEREIN

[75] Inventor: Lutz Kurzweg, Pittsburgh, Pa.

[73] Assignee: Monitor Group, Inc., Cheswick, Pa.

[21] Appl. No.: 20,089

[22] Filed: Feb. 19, 1993

Related U.S. Application Data

[63] Continuation-in-part of Ser. No. 915,590, Jul. 17, 1992, abandoned.

[51] Int. Cl.[5] ..... H01J 49/00

[52] U.S. Cl. ..... 250/296; 250/281; 250/290; 250/291

[58] Field of Search ..... 250/296, 290, 291, 299, 250/300, 281, 282, 423 R, 427

[56] References Cited

U.S. PATENT DOCUMENTS

| | | | |
|---|---|---|---|
| 2,882,410 | 4/1959 | Brobeck | 250/41.9 |
| 3,073,951 | 1/1963 | Burdg | 250/41.9 |
| 3,590,243 | 6/1971 | Perrin et al. | 250/41.9 |
| 3,955,084 | 5/1976 | Giffin | 250/281 |
| 4,175,234 | 11/1979 | Hunt et al. | 250/427 |
| 4,298,795 | 11/1981 | Takeuchi et al. | 250/282 |
| 4,473,748 | 9/1984 | Konagai et al. | 250/299 |
| 4,882,485 | 11/1989 | Duryea | 250/288 |
| 4,952,802 | 8/1990 | Duryea | 250/288 |
| 5,155,357 | 10/1992 | Hemond | 250/281 |

*Primary Examiner*—Paul M. Dzierzynski
*Assistant Examiner*—Kiet T. Nguyen
*Attorney, Agent, or Firm*—Arnold B. Silverman

[57] ABSTRACT

A cycloidal mass spectrometer having a housing which defines an ion trajectory volume, an electric field generator for establishing an electric field within the ion trajectory volume, and an ionizer for receiving gaseous specimens to be analyzed and converting the same into ions which travel through orthogonal electric and magnetic fields and impinge upon a collector. The spectrometer is designed to have a plurality of ions of different mass to charge ratios impinging on the collector generally simultaneously. A processor determines the mass distribution of the ions impinging upon the collector. A plurality of electric field plates are electrically insulated from each other and may be sealed so as to define the ion trajectory volume. In another embodiment, an assembly of electric field plates are disposed within a vacuum enclosure. A miniature ionizer preferably has a miniature filament. The cycloidal mass spectrometer and ionizer may be miniaturized so as to provide for a small, readily portable instrument.

58 Claims, 7 Drawing Sheets

CYCLOIDAL MASS SPECTROMETER AND IONIZER FOR USE THEREIN

RELATED APPLICATION

The present application is a continuation-in-part of U.S. patent application Ser. No. 07/915,590, filed Jul. 17, 1992, now abandoned.

BACKGROUND OF THE INVENTION

1. Field of the Invention

The present invention relates to an improved cycloidal mass spectrometer and to an ionizer which may be used therein and, more specifically, it relates to such apparatus which readily may be miniaturized.

2. Description of the Prior Art

The use of mass spectrometers in determining the identity and quantity of constituent materials in a gaseous, liquid or solid specimen has long been known. It has been known, in connection with such systems, to analyze the specimen under vacuum through conversion of the molecules into an ionic form, separating the ions by their mass to charge ratio, and permitting the ions to bombard a detector. See, generally, U.S. Pat. Nos. 2,882,410; 3,070,951; 3,590,243; 4,298,795. See, also U.S. Pat. Nos. 4,882,485 and 4,952,802.

In general, ionizers contain an ionizer inlet assembly wherein the specimen to be analyzed is received, a high vacuum chamber which cooperates with the ionizer inlet assembly, an analyzer assembly which is disposed within the high vacuum chamber and is adapted to receive ions from the ionizer. Detector means are employed in making a determination as to the constituent components of the specimen employing mass to charge ratio as a distinguishing characteristic. By one of many known means, the molecules of the gaseous specimen contained in the ionizer are converted into ions which are analyzed by such equipment.

It has been known with prior art cycloidal mass spectrometers to use a single fixed collector and ramped electric field in looking at only one mass to charge ratio at a time.

In known mass spectrometer systems, whether of the cycloidal variety type or not, the ionizers are quite large and, as a result, dominate the design and specifications of the systems to be employed therewith.

In spite of the foregoing system, there remains a very real and substantial need for an improved cycloidal mass spectrometer and for ionizers used therewith and with other types of mass spectrometers.

SUMMARY OF THE INVENTION

The present invention has met the hereinbefore described needs.

The invention, in one aspect, provides a cycloidal mass spectrometer having a housing which defines an ion trajectory volume, magnetic field generating means to establish a magnetic field within the ion trajectory volume, ionizer means for receiving the gaseous specimen being analyzed and converting the same into ions, collector means for simultaneously receiving a plurality of ions of different masses with the position of impingement on the collection means being indicative of the mass of the ion, and processing means which convert information received from the collection means to a mass distribution determination.

The mass spectrometer preferably employs a plurality of electric field plates which are sealingly connected to each other and have an electrically insulative material separating electrically conductive portions of adjacent plates such that the electric field plates serve a double purpose of both their normal function and cooperating to define the high volume ion trajectory volume, thereby eliminating the need to employ separate structures for such purposes.

A miniaturized ionizer is preferably employed in the short leg of the cycloidal mass spectrometer. It is composed of a ceramic material and preferably has a miniature wire type filament.

It is an object of the present invention to provide a reduced size, portable cycloidal mass spectrometer.

It is a further object of the invention to provide such a mass spectrometer which can simultaneously analyze ions of different mass to charge ratios.

It is further object of the present invention to provide such a system wherein electric field plates serve to seal the ion trajectory volume and define the wall of the vacuum system.

It is a further object of the present invention to provide such a system which employs efficient ion collection means.

It is another object of the present invention to provide a miniaturized ionizer which is usable within a cycloidal mass spectrometer and in other systems wherein ion generation is needed.

It is yet another object of the present invention to provide a miniaturized ionizer which can operate at pressures higher than normally considered ideal while making ionization more efficient.

These and other objects of the invention will be more fully understood from the following detailed description of the invention on reference to the illustrations appended hereto.

DESCRIPTION OF THE PREFERRED EMBODIMENTS

Figure 1:
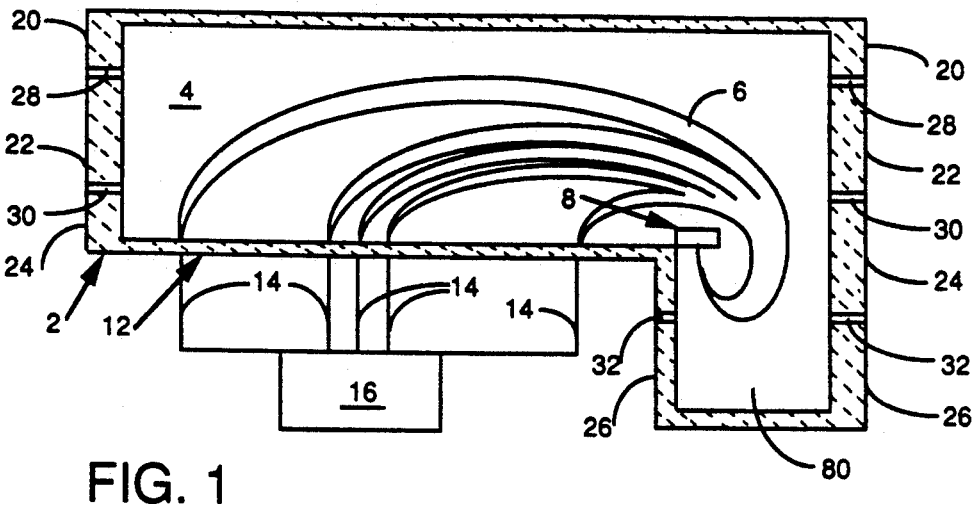
FIG. 1 is a schematic cross-sectional illustration of the ion trajectory volume of a cycloidal mass spectrometer of the present invention.

While the actual path of movement of the ions in the mass spectrometer disclosed herein might best be described as a "trochoid," it has been accepted in the art to refer to such a mass spectrometer as a "cycloidal mass spectrometer" and this latter term is being employed herein.

Referring once again to FIG. 1, there is shown a cycloidal mass spectrometer which has a housing 2 defining an ion trajectory volume 4 in which is a magnetic field having its B field going into the drawing and the plate produced E field going perpendicular to the B field and toward the top of the page. The magnetic field establishes flow of the ion beam 6 which emerges from the ionizer means 8. The ion beam 6 splits according to ion mass to charge ratio and impinges upon different portions of the collection means 12 with the ions of lesser mass impinging upon the collection means 12 at a distance closer to the ionizer 8 than those ions of greater mass. It will be noted that the collection means 12 receives a plurality of ions having different mass to charge ratios simultaneously. Impingement of the ions on the collection means 12 causes a responsive current to flow through leads 14 to processing means 16 wherein determinations are made as to the mass distribution of the ions in ion stream 6. This permits a quantitative and qualitative determination of the materials present in the gaseous sample which was introduced into the ionizer means 8.

In the form illustrated, the collection means 12 is disposed within a first portion of the interior of the housing 2 having a first dimension and the ionizer means 8 is disposed within a second portion of the housing 2 (short leg 80) having a second dimension greater than the first dimension. In the form illustrated, the first and second dimensions are the heights of the housing interior taken in the housing orientation shown in FIG. 1. The ionizer means 8 discharges the ions in the form illustrated in a generally downwardly direction within the second portion which is generally away from the first portion. The ions travel in the ion beam 6 to the collection means 12 in the first portion.

Referring still to FIG. 1, there is shown a plurality of circumferential electrically conductive metal electric field plates 20, 22, 24, 26 which are electrically separated from each other by electrically insulating material 28, 30, 32 which may be ceramic, glass, a low vapor pressure polymer, or combinations thereof.

Where the plates 20, 22, 24, 26 (apart from the electrically conductive coatings applied thereto) are made of electrically insulative materials, the materials per se may function as the insulating material without using a separate material. In the embodiment where the plates 20, 22, 24, 26 are composed of an electrically insulative material such as alumina, for example, the lower surface and a circumferentially continuous lower portion of the inner surface of a plate will be coated with an electrically conductive material. The upper surface of the plate and a circumferentially continuous upper portion of the inner surface of the plate will be coated with an electrically conductive material. A gap will be left between the upper and lower inner coated portions. The upper surface of one plate may be joined to the lower surface of an overlying plate by suitable means, such as brazing, for example, to provide a sealed joint therebetween.

In this manner, the electrical field plates 20, 22, 24, 26 cooperate to define the ion trajectory volume 4 which is under vacuum. The "ion trajectory volume" is a space within the field plates in which the analyzed ions travel from the ion source exit slit to the focal plane. Any desired number of such plates may be employed in defining the electric field forming section of the cycloidal mass spectrometer housing. As the electric field plates are sealed, there is no need to employ a separate vacuum chamber.

Figure 2:
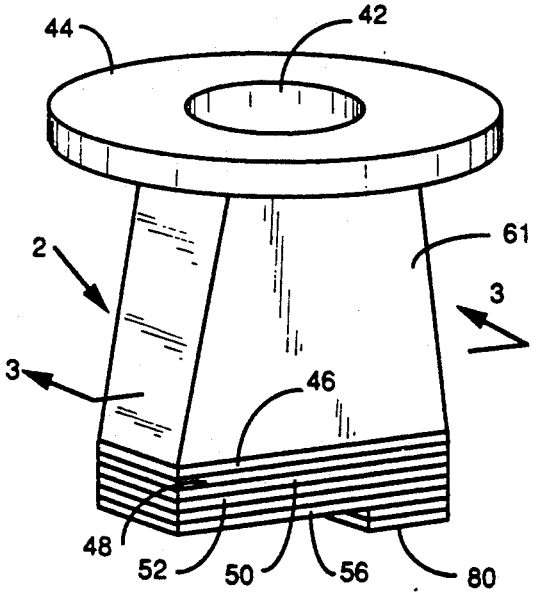
FIG. 2 is a perspective view of the exterior of the cycloidal mass spectrometer of the present invention.
Figure 3:
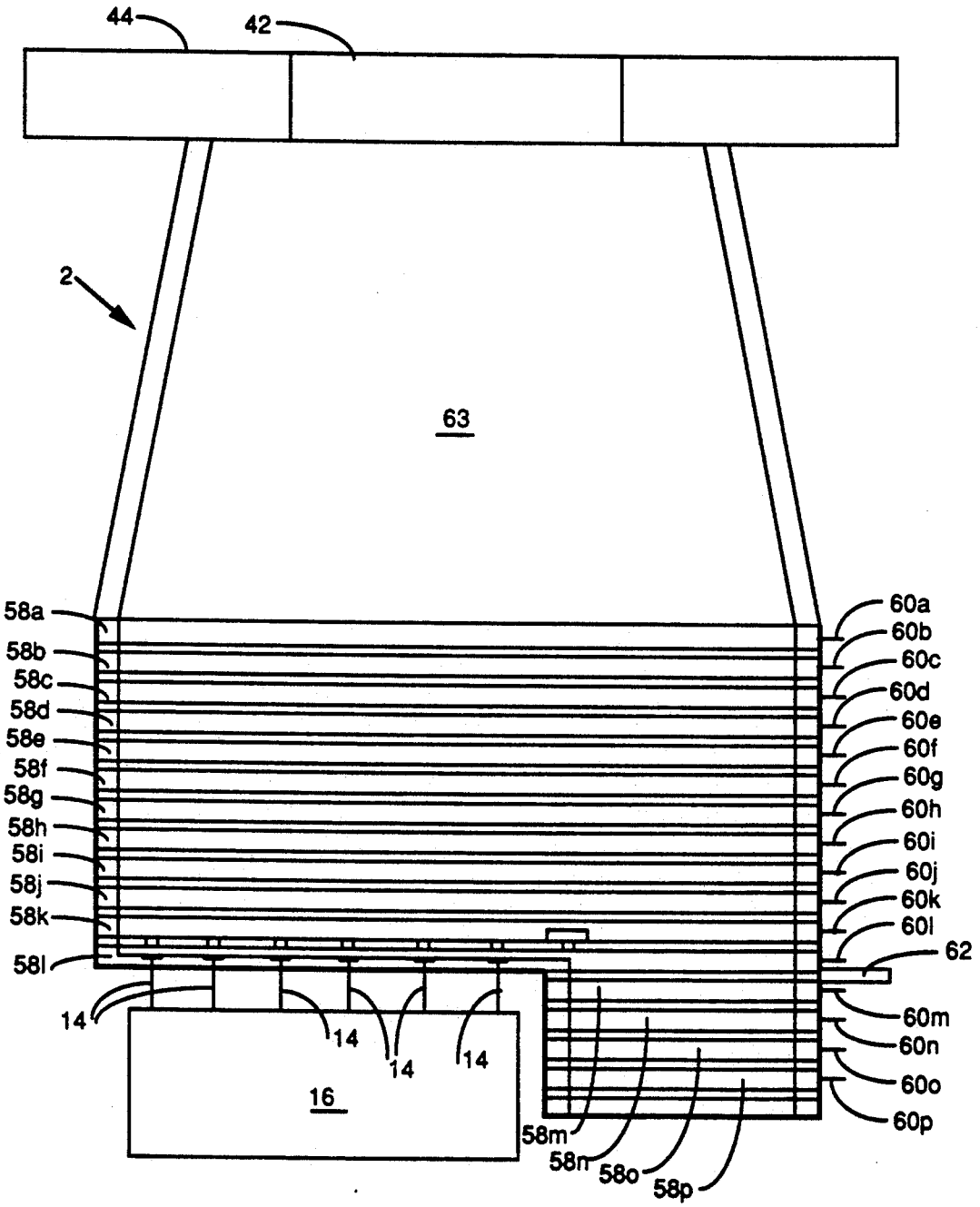
FIG. 3 is a vertical cross-sectional illustration of the cycloidal mass spectrometer of FIG. 2 taken through 3—3.

As shown, with reference to FIGS. 1 through 3, the plate defined, ion trajectory volume 4, is in the lower portion of the housing 2 of the cycloidal mass spectrometer. Housing 2 tapers generally upwardly and communicates with opening 42 of the flanged upper portion 44 so as to permit connection to a suitable vacuum pump (not shown). As shown in FIG. 2, the collector plates indicated generally as 46, 48, 50, 52, 54, 56 may be provided in any desired number depending on the ultimate resolution desired. In FIG. 3, the array of vertical stacked plates **58*a* through 58*p* are, in the form shown, generally rectangular in external peripheral configuration and have a generally rectangular opening therein. The upper plates 58*a* through 58*k* are generally of the same size and shape and have aligned openings of the same size. The lower plates 58*l* through 58*p* are each of generally the same size and shape and have aligned openings of the same size. Each plate 58*a*–58*p* has its own electrical supply wire 60*a* through 60*p* to supply electricity thereto. A gas inlet 62 supplies the gaseous sample to be analyzed to ionizer 8 (FIG. 1). The processing means 16 receive electrical signals from the collection means 12 (FIG. 2) by electrical leads 14**.

Figure 4:
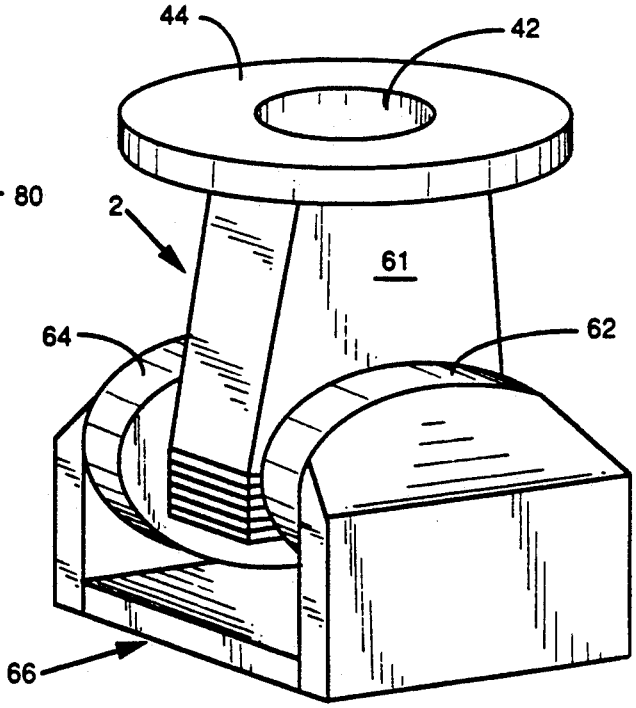
FIG. 4 shows a form of the cycloidal mass spectrometer of FIG. 2 positioned between the two poles of magnetic field generating means.

As shown in FIGS. 2 through 4, the generally flat parallel opposed surfaces 61, 63 of the housing 2 are positioned between the poles 62, 64 of permanent magnet 66 or an electromagnetic so as to place the electric field plates within the magnetic field generated between poles 62, 64. As shown in FIG. 1, the ions emerging from ionizer means 8 travel to the collection means 12 under the influence of this magnetic field.

Figure 5:
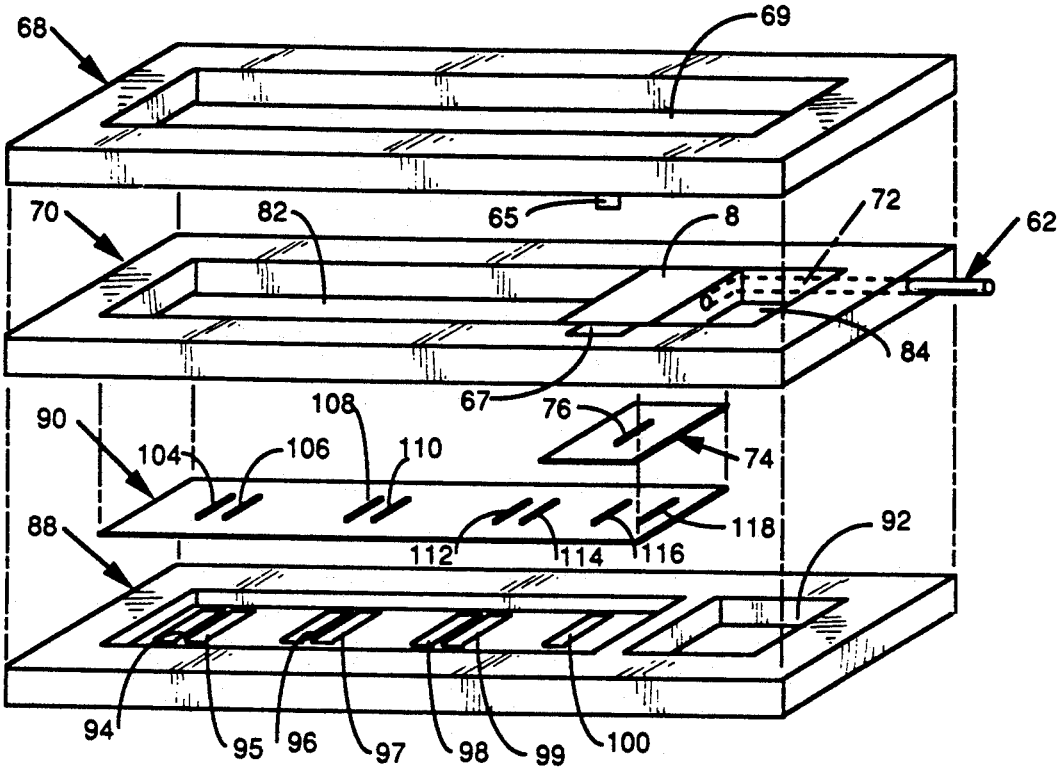
FIG. 5 is an exploded view of a form of collection means of the present invention.

Referring to FIG. 5, there is shown an exploded view of a form of electric field plate arrangement usable in the present invention. These plates in the preferred embodiment are composed of an electrically nonconductive, nonporous ceramic material such as high density alumina, which may be coated on the upper and lower surfaces and interior surface, (with gaps as described hereinbefore) which is exposed to the ion trajectory volume 4, with a suitably electrically conductive material such as molybdenum, molybdenum-manganese, nickel and copper, for example. Adjacent electrically conductive coatings will be electrically insulated from the adjacent electrically conductive coatings on the plates.

The filament plate 68 is the uppermost plate and in the form shown is generally rectangular in shape and defines a rectangular opening 69. Underlying filament plate 68 and adapted to be separated therefrom by electrically insulative material is ionizer plate 70 within which ionizer 8 is positioned with its injector plate 74 having an elongated slit 76 secured to the undersurface thereof. The gaseous specimen enters ionizer 8 through gas inlet 62 which extends through a metallized passageway 72 in plate 70. The gas inlet tube 62 preferably serves to not only introduce the gaseous specimen into the ionizer, but also serves to place voltage on the repeller. The electrically energized filament 65 is secured to filament plate 68 and is received within recess 67. It will be appreciated that in this manner ions generated in the ionizer means 8 from the gaseous specimen introduced thereinto, by means to be described hereinafter, will be discharged in a generally downward direction within the short leg 80 (See FIGS. 1 and 2) of the ion trajectory volume 4. It will be appreciated that the ionizer means 8 is disposed within opening 82 defined by plate 70 and is in spaced relationship with respect to interior end 84 of the opening 82.

The collection means includes collection plate 88 and associated overlying apertured plate 90. Collection plate 88 is generally rectangular in shape and is preferably of essentially the identical shape and size as plates 68, 70. The opening 92 defined within collection plate 88 has a plurality of detectors 94, 95, 96, 97, 98, 99, 100 which underlie and are operatively associated with generally parallel slits 104, 106, 108, 110, 112, 114, 116, in apertured plate 90 which is disposed in the focal plane. Slit 118 is aligned with slit 76 of injector plate 74 and serves as ion entrance slit to the cycloidal system. If desired, injector plate 74 may be eliminated and slit 118 may also serve as ionizer exit slit.

Referring to FIGS. 1 and 5, it will be appreciated that ions traveling in beam 6 will impinge upon various portions of apertured plate 90 but will pass through only those portions of the apertured plate 90 wherein the generally parallel slits 104, 106, 108, 110, 112, 114, 116 are present. The ions passing through these slits will impinge upon the underlying detectors 94, 95, 96, 97, 98, 99, 100 and produce a plurality of responsive currents which will be received by processing means 16 through electrical leads 14 (FIG. 1) and be processed in such a manner to provide the desired information as to the quantitative and qualitative content of the major ingredients of the gaseous specimen. This information might be stored in a computer, visually displayed on an oscilloscope, provided in hard copy, or handled in any other desired manner.

Figure 6:
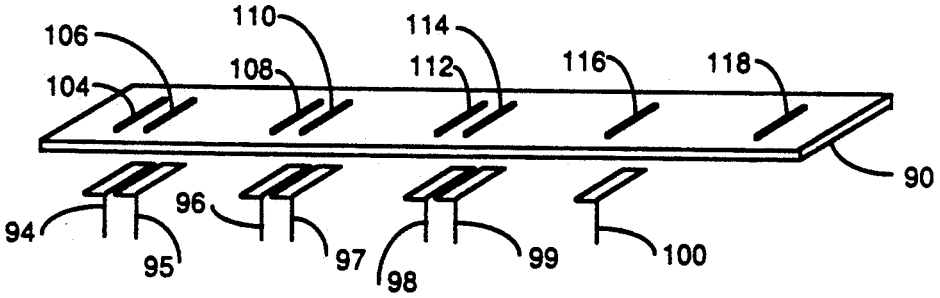
FIG. 6 is a schematic illustration of one embodiment of collection means of the present invention.

FIG. 6 shows a detailed illustration of one embodiment of the portion of the collection means shown in FIG. 5. The apertured plate 90 has its slits 104, 106, 108, 110, 112, 114, 116 each overlying one of the detectors 94, 95, 96, 97, 98, 99, 100. In a preferred embodiment the collectors 94, 95, 96, 97, 98, 99, 100 are Faraday plate ion collectors. Each collector's current may be read in the processing means 16 by a separate amplifier (not shown) in a manner well known to those skilled in the art or, in the alternative, a single amplifier and a multiplexing system may be employed.

In this embodiment of the invention the apertured plate 90 may be made of stainless steel having a thickness of about 0.002 inch. It is also preferred that the orientation of the slits 104–118 (even numbers only) be not only parallel to each other, but also parallel to the slit 76 in the ionizer means injector plate 74 (FIG. 5). The slits preferably have a width of about 0.003 inch. As will be apparent, the positioning of the slits will be determined by what specific ion masses that are to be observed.

It will be appreciated that this system permits detection of a plurality of ions of different mass to charge ratios simultaneously and thereby provides a highly efficient means of analyzing a gaseous specimen.

In this embodiment as well as the other embodiments of collection means 12, it is preferred that the entrance to the apertured plate 90 be preferably positioned generally in the focal plane of the apparatus.

Figure 7:
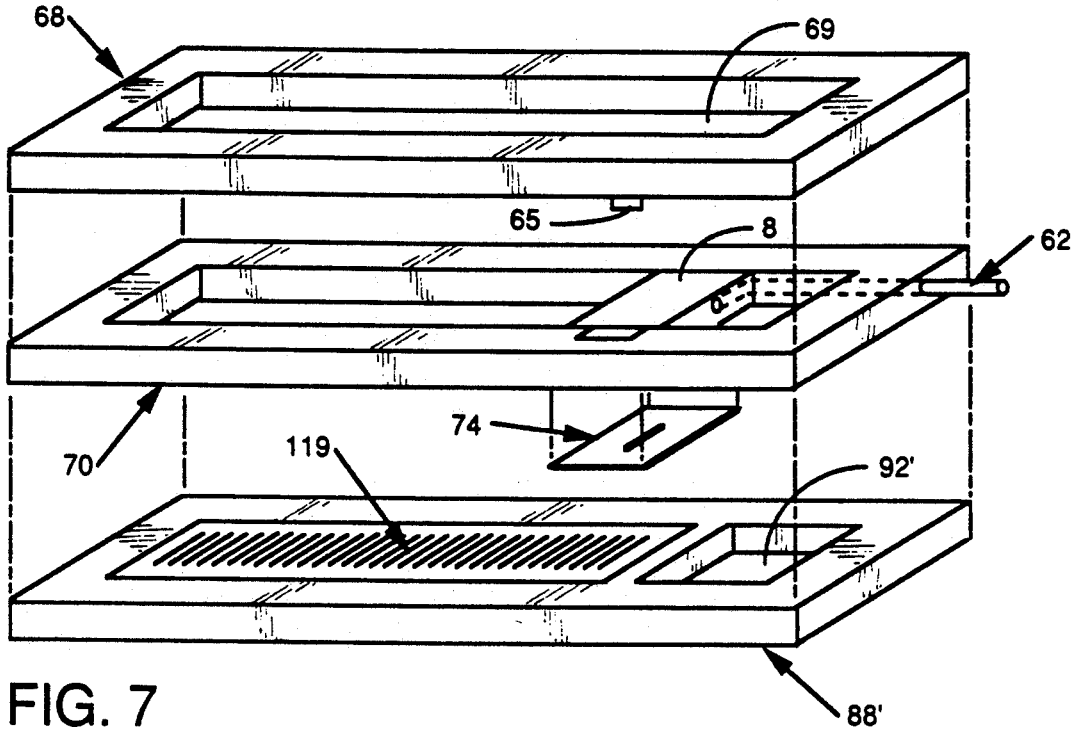
FIG. 7 is an exploded view of a second embodiment of collection means of the present invention.

Considering FIG. 7, a second embodiment of the collection means will be considered. An array of collectors of a charged coupled device is employed. In this embodiment, the ion current activates the charge coupled device 119 due to direct or induced ion current coupling to the array of the charge collectors. The entire mass spectrum may be employed or, in the alternative, only isolated desired parts of the mass spectrum may be employed. Also, if desired, resolutions higher than those that may be obtained in the static mode may be achieved by dithering the electric field and monitoring the signals to the collectors as a differential in time. The charge coupled device 119 may have the charge coupled array directly established on the ceramic material of plate 88' or may be created as a separate entity and secured to the plate 88'.

The second embodiment of collection means, as shown in FIG. 7, eliminates the apertured plate and ion charges are collected directly or induce a charge directly on the array. As prior art systems employ photons which are capable of traveling through nonconductive materials, these systems are not desirable for direct ion detection.

Figure 8:
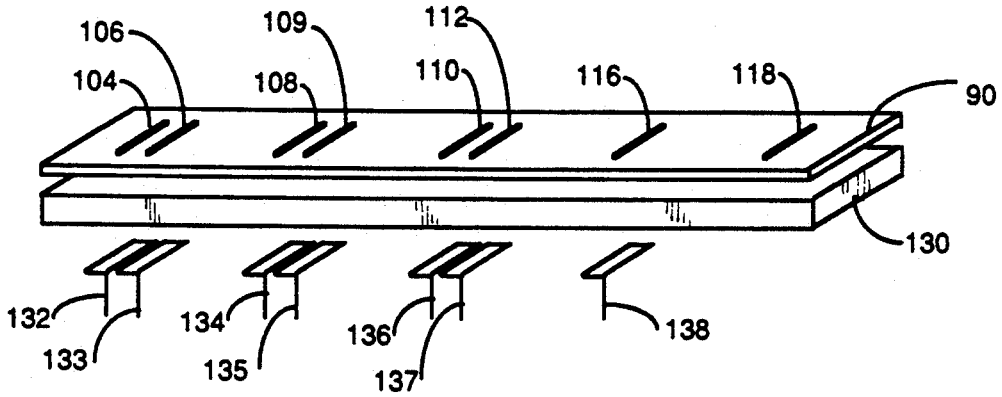
FIG. 8 is a schematic illustration of a third embodiment of the collection means of the present invention.

Referring to FIG. 8, a further embodiment of the collection means of the present invention will be considered. In this embodiment, underlying the apertured plate 90 is a channel plate 130 under which a plurality of detectors 132–138 are provided in aligned position with respect to slits 104–116 (even numbers only). The channel plate 130, which may be a leaded glass channel plate, is preferably positioned just below the focal plane of the cycloidal mass spectrometer. As the focal plane is at ground potential and the front of the channel plane must be at a high negative potential, the focal plane is occupied by a plate 90 which in this embodiment is a grounded metal screen provided with the slits 104–118 (even numbers only). Due to the high magnetic field involved, channel diameters of less than 10 microns are preferably used. In this channel plate embodiment, an ion hits on the leaded glass channels and cause a number of secondary electrons, each of which are accelerated down the channel to produce more electrons, this cascading process produces the amplification. The current going to the detectors 132–138 will be an electron current and will have a magnitude about four orders of magnitude higher than the ion current. The processing means 16 will then process the electrical signals.

Figure 9:
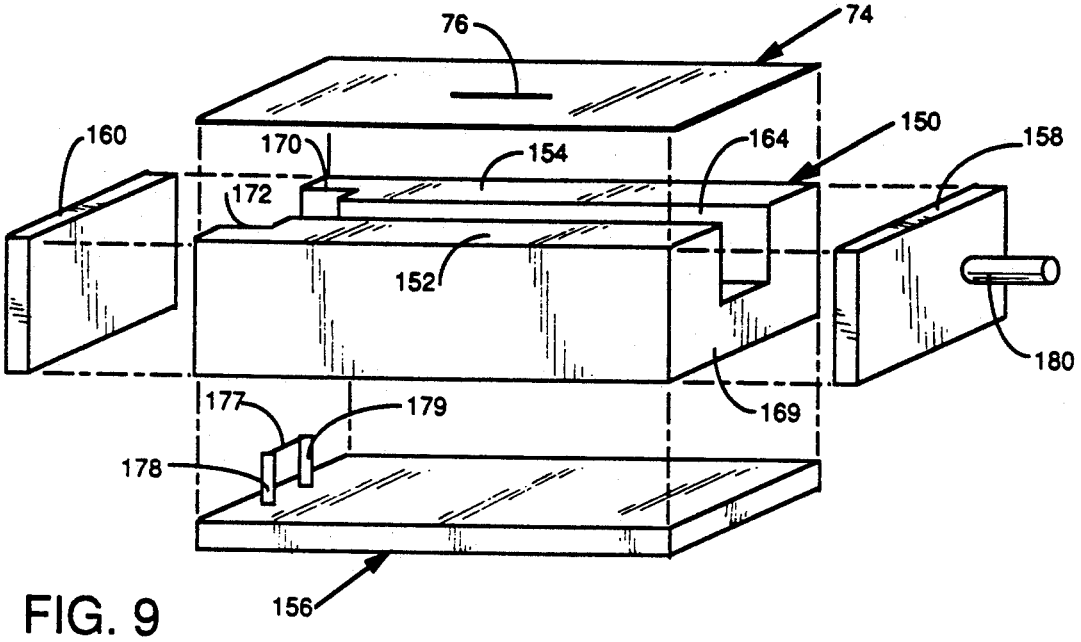
FIG. 9 is an exploded view of the miniaturized ionizer of the present invention.
Figure 10:
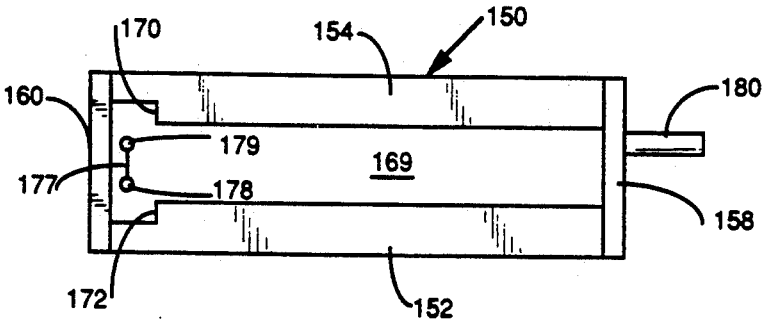
FIG. 10 is a top plan view of the miniature ionizer of FIG. 8 without the injector plate in place.

Referring now to FIGS. 9 and 10 an ionizing means 8 of the present invention will be considered in greater detail. It will be appreciated that while the miniaturized ionizer means of the present invention are adapted to be used in the portable cycloidal mass spectrometer of the present invention, it may be used in other installations where it is desired to convert a gaseous specimen to ions. The ion volume block 150 is preferably composed of an electrically insulative, substantially rigid material which will be inert to the gaseous specimens to be reintroduced therein. Among the suitable materials for such use are high density alumina, preferably of about 94 to 96 percent purity. The ion volume block 150 is elongated and has a pair of upstanding, generally parallel sidewalls 152, 154, a base 169 and a pair of endwalls 158, 160. These cooperate to define upwardly open recess 164. Formed within the endwall 158 is a gaseous specimen introducing opening which cooperates with gas inlet tube 180. The portion of the sidewalls 152, 154 adjacent to endwall 160 have shoulders 170, 172. In this portion of the base 156, which serves as the filament plate, is a filament 177 which may be a wire filament which may be made of tungsten, thoria coated indium or thoriated tungsten, for example. It is supported by posts 178, 179. The filament 177 is preferably electrically energized by a suitable wire (not shown) to effect resistive heating to incandescence by currents on the order of a few amps. The filament 177 may be a ribbon about 0.001 inch thick, about 0.005 inch wide and about 0.100 inch long.

The generally channel shaped body portion or block 150 cooperates with endwalls 158, 160 and the injector plate 76 to define the ionizer chamber.

In lieu of using filament 177, the ionizer volume block 150 may have its interior surface coated with a suitable electrically conductive metal which is electrically energized. The electric fields are produced by applying voltages to the metal coated ceramic high density alumina walls. The metal coating on the ceramic produces equal potential surfaces and conductive traces which allow the surface potentials to be applied from outside the device. Inlet tube 180 which receives specimen gases from inlet tube 62 by means of the connecting passageway (not shown) for introduction of the gas specimen is in communication with recess 164. Inlet tube 180 is disposed at the opposite end of recess 164 from filament 177 and exit slot 76 is disposed between such ends.

Suitable means for introducing a gaseous specimen into the inlet tube 62 is disclosed in co-pending U.S. application Ser. No. 07/911,469, filed on Jul. 10, 1992 in the names of Kurzweg and Duryea and entitled "Inlet Valve Apparatus for Vacuum Systems," the disclosure of which is incorporated herein by reference. The ionizer means 8 also has injector plate 74 positioned with its slot 76 generally parallel to the longitudinal extent of the ion volume block 150.

In the preferred embodiment of the invention the ionizer means will have an exterior length of about 3/16 to ½ inch, an exterior width of about 1/16 to 3/16 inch and an exterior height of about 3/16 to 5/16 inch. The ionizer means has an interior passageway having a length of less than about 1/5 inch. The mean free paths between electron-molecule collisions at about 10 microns of pressure are about this length. As a result, these devices will function efficiently at these pressures. It will be appreciated that in this manner this compact ionizer may be employed in a very small space within a mass spectrometer and thereby contribute to reduction in size, and provide portability and enhanced efficiency.

The cycloidal mass spectrometer of the present invention preferably has an interior which has a height of about 1 to 3 inches, a width of about 3/8 to 5/8 inch and a depth of about 2 to 4 inches.

The ion trajectory volume preferably has an interior length of about 1.50 to 2.0 inch, an interior width of about 0.30 to 0.70 inch and an interior height in the region of the collector means of about 0.6 to 1.5 inch.

It will be appreciated that electrons emerging from the filament 177 are accelerated within the ion volume by a potential difference between the filament 177 and the ion volume potential. These potentials are applied by voltage sources disposed outside of the analyzer assembly and are directed to the applied location by means of the metallic coating traces on the ceramic plates. These electrons are entrained to move within the ion volume by a magnetic field which may be on the order of about 4000 Gauss.

It will be appreciated that the specimen gas to be evaluated is introduced directly into the ion volume and is provided with no major exit path other than the aperture 76 in the injector plate 74. Ions are extracted from the ionizer by the combined potentials of the injector and the ion volume potential.

It will be appreciated while the injector plate 74 is shown with elongated linear slit 76 in some uses slits having a different shape may be desired and employed.

It will be appreciated that by employing ionizer means 8 of such small size the ionizer may be placed within or in close proximity to the analyzing magnets that establish the magnetic field. The analyzing magnet as a result, produces a field which also serves as the electron beam confining field. The magnetic field is placed parallel to the electron beam direction. Any component of electron velocity away from a magnetic field line will cause the electron to circle the field line. As a result, the magnetic field confines and directs the electron beam. If no magnetic field already exists, an ionizer magnet positioned so that its field lines are in the direction of the electron beam can be employed to improve performance.

The apparatus of the present invention is double focusing in that ions of one mass to charge ratio focus at one place on the collection means regardless of the initial ion energy spread or a spread in the ion injection angle.

It will be appreciated that the apparatus of present invention facilitates the use of miniaturized portable equipment which will operate with a high degree of efficiency and permit simultaneous impingement of the plurality of ions on the collection means 12 thereby facilitating measurement of ions of different mass to charge ratios simultaneously. It will further be appreciated that all of this is accomplished using a unique ionizer means which is suitable for use in the apparatus disclosed herein as well as other apparatus wherein conversion of gaseous specimen to ions is desired.

Another advantage to the present construction is that it allows the vacuum system/ion trajectory volume to be more narrow than other cycloidal mass spectrometers. The system also operates with a magnetic field gap which is about one-half the width that would normally be required if separate field plates and vacuum walls were employed. The apparatus employs a very uniform magnetic field the magnet gap width of which will generally be rather small such as on the order of about ⅜ to ⅝ inch, thereby facilitating the use of magnets which are much smaller.

Numerous end uses of the cycloidal mass spectrometer and the ionizer means of the present invention will be apparent to those skilled in the art. Among such uses will be efforts to determine purity of air in order to comply with legislation establishing requirements therefor, auto exhaust gas analysis, uses in analytical chemistry such as in gas chromatography mass spectrometry and uses in the medical fields, such as in an anesthetic gas monitor.

It will be appreciated that the present invention provides apparatus for measuring the mass to charge ratio of a plurality of ions impinging on collection means simultaneously. Also, unique electric field plates serve to define the ion trajectory volume. In addition, unique ionizer means, which may be of very small size, are provided.

While a preferred feature of the invention provides a plurality of field plates, each coated on the interior with electrically conductive traces, it will be appreciated that the invention is not so limited. If desired, the ion volume may be defined by a unitary molded structure made from a low vapor pressure elastomer such as a suitable rubber or plastic. A suitable material is that sold under the trade designation "Kalrez" by E. I. DuPont de Nemours. The unitary construction may be made of the same size and configuration as the assembled array of plates and have the electrically conductive tracings applied thereto.

Figure 11:
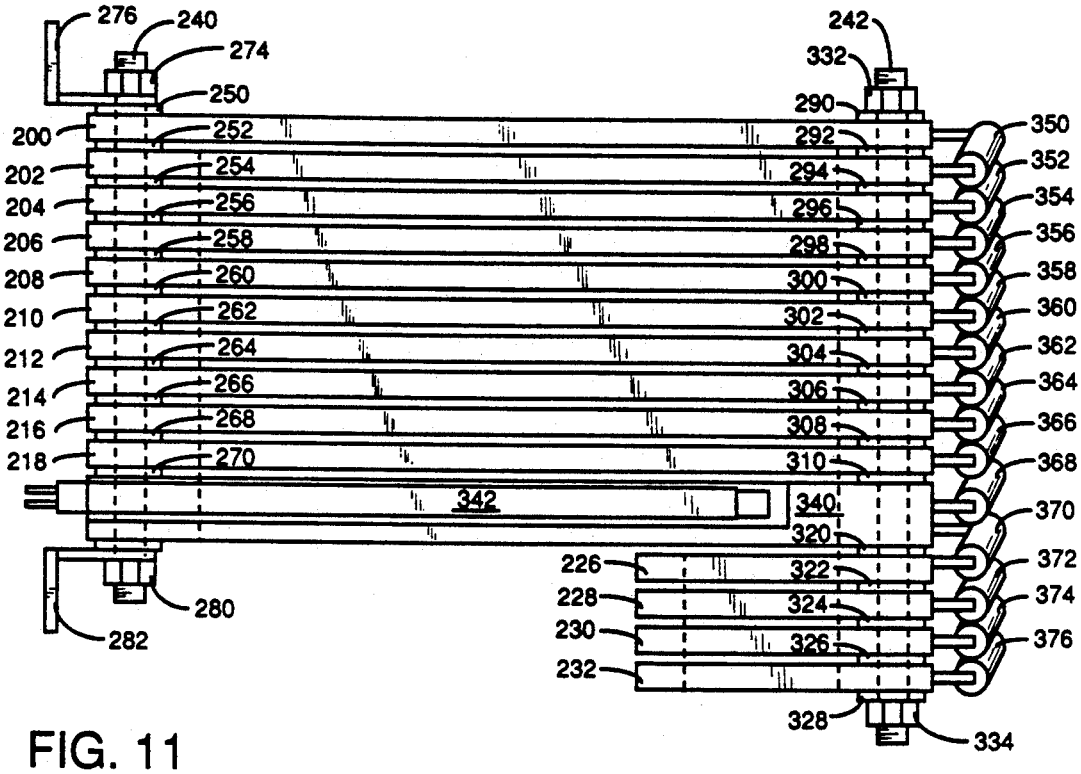
FIG. 11 is a schematic illustration of a modified form of cycloidal mass spectrometer of the present invention.
Figure 13:
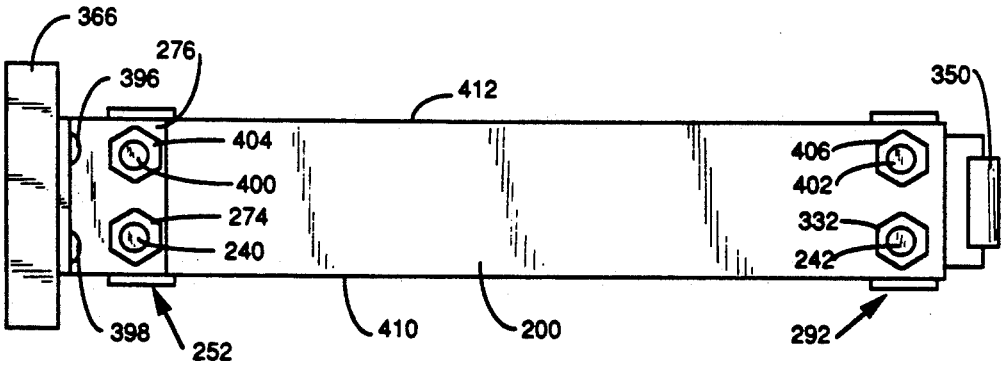
FIG. 13 is a top plan view of the spectrometer of FIG. 11.
Figure 12:
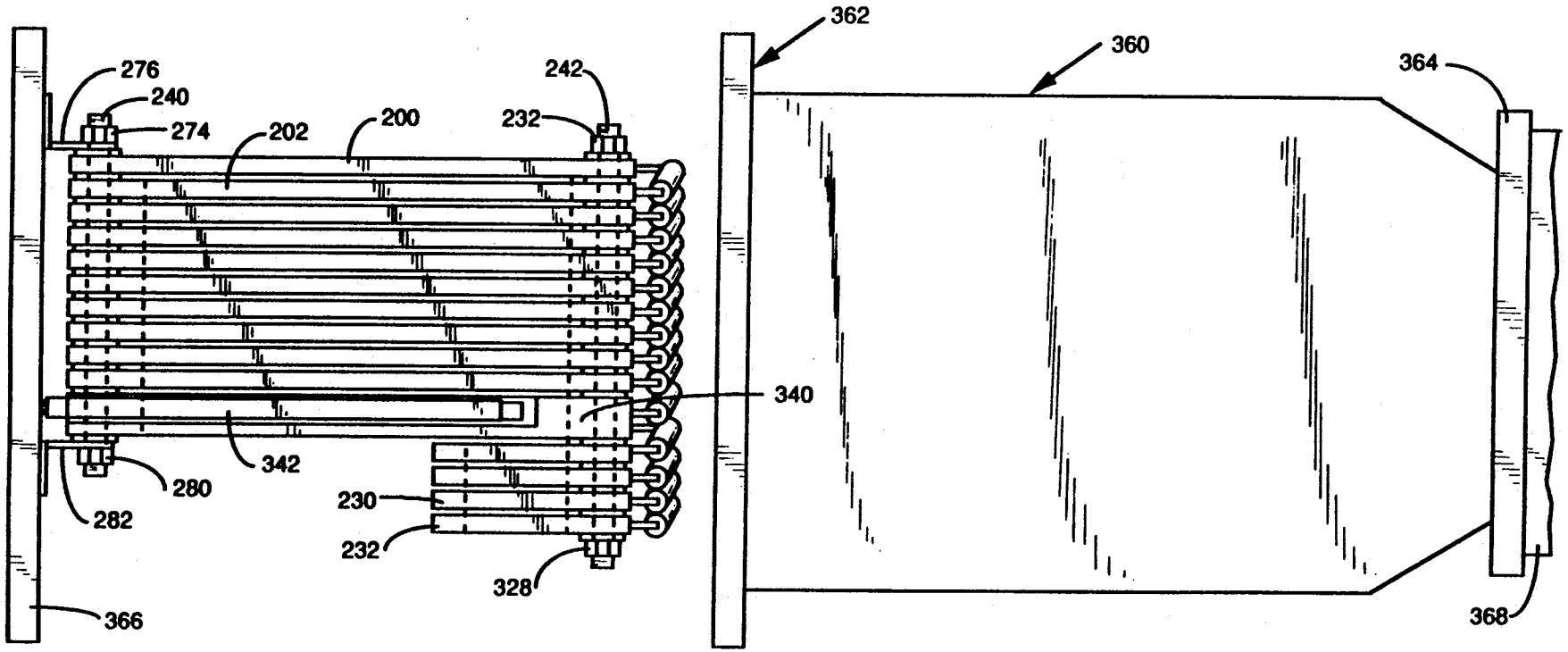
FIG. 12 is a schematic illustration of the mass spectrometer of FIG. 11 and its associated enclosure.

Referring to FIGS. 11 and 12, an additional embodiment of the invention will be considered. Whereas, in the prior embodiment, emphasis has been placed upon the use of ceramic or other electrically non-conductive material having coated thereon electrically conductive traces and having such construction sealed to define the ion volume, the present embodiment takes a different approach. More specifically, it contemplates the use of a plurality of electrically conductive plates which are electrically insulated from each other and the use of a separate vacuum enclosure to receive the assembly of plates. The plates may generally be of the same configuration and dimensions as those discussed hereinbefore. The array of negative plates 200–218 (even numbers only) are disposed in relative spaced relationship to each other. A series of positive plates 226, 228, 230, 232 are disposed in relative spaced relationship to each other. The positive plates have threaded rods 240 and 242 passing through openings therein with a plurality of electrically insulative washers 250–270 (even numbers only), have rod 240 pass therethrough, and serve as spacers between the respective plates 200–218 (even numbers only). As shown in FIG. 13 and described in greater detail hereinafter, rods 400, 402 which are similar to rods 240, 242 and disposed, respectively, in spaced relationship to rods 240, 242. The washers may conveniently be made of alumina and be about 0.024 inch thick. The washers 250–270 (even numbers) preferably extend about 0.015 inch beyond the stack and serve to insulate the plates from the metal surfaces of the vacuum envelope which will be described hereinafter. Nuts 274, 280 serve to secure mounting brackets 276, 282 and secure the assembly of plates 200–218 (even numbers only). Similarly, threaded rod 242 passes through a plurality of washers 290–310 (even numbers only) to provide spacing and insulation between the respective plates 200–218 (even numbers only). Also, washers 320–328 (even numbers only) have rod 242 passing therethrough and separate positive plates 226–232 (even numbers only). Nuts 332, 334 are threadedly secured to rod 242 and establish the assembly. The ionizer 340 and filament assembly 342 are interposed between the negative plates 200–218 and positive plates 226–232. The individual potentials of plates 200–218 and 226–232 are distributed by means of a plurality of vacuum compatible resistors 350–376 (even numbers only) which are used as a voltage dividing resistor chain. The resistors are preferably spot-welded to the plates 200–218 and 226–232 and form an integral part of the flange mounted assembly.

In this embodiment of the invention, the electric field plates 200–218 and 226–232 are made of stainless steel and preferably annealed 304 stainless steel, having a thickness of about 0.072 inch. The rods 240, 242 are preferably 56 304 stainless steel threaded rods insulated with exteriorly disposed alumina tubing.

As this embodiment does not have the sealed plates as described in the ceramic embodiment hereinbefore described, this embodiment employs a separate vacuum enclosure 360 (FIG. 12) within which the assembly of steel plates is received. The vacuum enclosure 360 is preferably formed of 304 stainless steel tubing which may be shaped by a mandrel and have vacuum flanges 362, 364 welded to opposed ends. The flange 362 may be secured to front plate 366 by a plurality of Allen Head Machine Screws (not shown) which secure flange 362 to front plate 366 in order to establish a vacuum seal therebetween. The flange 364 may be secured in a vacuum tight seal to the ion pump 368 by a plurality of machine screws. The vacuum seal is created by crushing a metal O-ring made of silver-tin, copper or aluminum, for example, between flange 362 and front plate 366 with tightening being effected by the screws. The front plate 366 may be secured to the mounting brackets by screws such as 396, 398 in FIG. 13 or spot welding, for example.

It will be appreciated that in this manner, in this embodiment, the vacuum chamber is defined by the vacuum enclosure 360, rather than being formed integrally with the plates defining the same. This embodiment otherwise functions in the same manner as the prior embodiment.

The ion source within the ionizer 340 may either be made as previously described herein, or may be made of stainless steel, such as 304 stainless steel and coated with a low vapor pressure insulating polymer on its inside surface. A suitable polymer for this purpose is Varian "Torr Seal." The vacuum feedthrough allows for the passage of positive plate potential, negative plate potential, filament current end filament potentials, repeller potential, and gas from atmospheric pressure to high vacuum. These electronic currents and potentials may originate in the electronics unit (not shown) and pass into a high vacuum.

When the plate assembly, secured to the front plate 366, is placed within the vacuum enclosure 360, the vacuum enclosure is compresssion sealed by use of metal gaskets which are disposed between the glanges which are secured by Allen Head Screws.

As is shown in FIGS. 11 and 12, the plates 202–218 and 226–232 have a generally rectangular central opening as represented on each plate by a pair of spaced vertically oriented parallel dotted lines. The top plate 200, in the form shown, does not have such an opening.

As shown in FIG. 13, the mounting bracket 276 is secured to plate 366 by screws 396, 398. Bracket 282 may be secured to plate 316 in the same manner. Rods 240, 400 pass through mounting bracket 276 and the underlying plates 200–218 and are secured at their upper ends by nuts 274, 404 respectively, and other nuts (not shown) at the lower ends of rods 240, 400. Similarly, rods 242, 402 pass through plates 200–228 and 226–232 and are secured at their upper ends by nuts 242, 402 respectively, and other nuts (not shown) at the lower ends of rods 242, 402.

In order to resist undesired electrical contact between the plates 200–218, 226–232, and the interior of vacuum enclosure 360, electrically insulative washers 252–270 and 322–328, such as 252 and 292 shown in FIG. 13 are preferably continuous and rectangular and have their ends projecting beyond plate sides 410, 412. The washers preferably have a thickness of about 0.030 to 0.020 a length of about 0.490 to 0.500 inch, and a width of about 0.18 to 0.22 inch.

Whereas particular embodiments of the invention have been described herein for purposes of illustration it will be evident that those skilled in the art that numerous variations of the details may be made without departing from the invention as set forth in the appended claims.

I claim:

1. A cycloidal mass spectrometer comprising,
a housing defining an ion trajectory volume,
magnetic field generating means for establishing a magnetic field within said ion trajectory volume,
ionizer means for receiving a gaseous specimen to be analyzed and converting the gaseous specimen into ions which are discharged therefrom,
collection means for simultaneously receiving a plurality of ions of different mass to charge ratios with the position of the ion impingement on said collector means being related to the ion mass,
said housing having a first portion within which said collection means are disposed of a first dimension and a second portion of a second dimension greater than said first dimension within which said ionizer means is disposed, and
processing means responsive to said collection means for determining the mass distribution of said ions.

2. The cycloidal mass spectrometer of claim 1 including
said ionizer means positioned to discharge said ions in said second portion in a direction generally away from said first portion and said collection means positioned to receive said ions within said first portion.

3. The cycloidal mass spectrometer of claim 2 including
said collection means including an elongated plate having a plurality of generally parallel slits, and
ion receiving means underlying said slits for receiving ions passing therethrough and emitting responsive currents.

4. The cycloidal mass spectrometer of claim 3 comprising
said plate being disposed generally in a focal plane of said mass spectrometer.

5. The cycloidal mass spectrometer of claim 4 including
said processing means has means for amplifying current received from said collection means and determining the amount of ions passing through each of said slits.

6. The cycloidal mass spectrometer of claim 5 including
said means for amplifying including an amplifier for each said slit.

7. The cycloidal mass spectrometer of claim 5 including
said means for amplifying including a single amplifier and multiplexer means for sequentially receiving and amplifying said current.

8. The cycloidal mass spectrometer of claim 3 including
said ion receiving means has a plurality of Faraday collectors.

9. The cycloidal mass spectrometer of claim 3 including
said ionizer means having an injector plate with a slit for discharge of said ions, and
said slit being generally parallel to said collector plate slits.

10. The cycloidal mass spectrometer of claim 9 including
said ionizer means slit being generally coplanar with said elongated plate.

11. The cycloidal mass spectrometer of claim 2 including
said collector means includes a collector array disposed generally in a focal plane of said mass spectrometer.

12. The cycloidal mass spectrometer of claim 11 including
said collector array having a plurality of charge coupled devices which are activated by the ion current.

13. The cycloidal mass spectrometer of claim 12 including
said processing means having means for amplifying said current and determining the amount of ions impinging on selected portions of said collection means.

14. The cycloidal mass spectrometer of claim 2 including
said collection means includes a plate-like member having a plurality of generally parallel slits disposed generally in a focal plane and a channel plate disposed thereunder.

15. The cycloidal mass spectrometer of claim 14 including
said collection means having a plurality of collectors underlying said channel plate for emitting an electrical current responsive to ions passing through said slits.

16. The cycloidal mass spectrometer of claim 15 including
said collectors are selected from the group consisting of Faraday collectors and charge-coupled devices.

17. The cycloidal mass spectrometer of claim 14 including
said plate-like member being a metal screen.

18. The cycloidal mass spectrometer of claim 2 including
said ionizer means discharging said ions in such a manner as to cause the ions to travel through said ion trajectory volume to said collection means, and
said housing having a plurality of electric field plates which define at least a portion of said ion trajectory volume.

19. The cycloidal mass spectrometer of claim 18 including
adjacent said plates being sealingly joined to each other.

20. The cycloidal mass spectrometer of claim 19 including
said electric field plates being composed of a conductive material and being electrically separated from each other by a material selected from the group consisting of ceramic, glass and low vapor pressure polymers.

21. The cycloidal mass spectrometer of claim 19 including
said magnetic field generating means disposed exteriorly of said housing for establishing said magnetic field within said ion trajectory volume.

22. The cycloidal mass spectrometer of claim 21 including
said magnetic field generating means being disposed on opposite sides of said housing.

23. The cycloidal mass spectrometer of claim 2 including said ionizer means having an ion volume block provided with a gas inlet opening for introducing the gaseous specimen into said volume, filament means, and an apertured injector plate.

24. The cycloidal mass spectrometer of claim 23 including said filament means having a wire filament.

25. The cycloidal mass spectrometer of claim 2 including said ionizer means discharging ions in such a manner as to cause the ions to travel through said ion trajectory volume to said collection means, and at least a portion of said ion trajectory volume being defined by a unitary molded ion trajectory volume having a plurality of electrically conductive zones electrically insulated from each other.

26. The cycloidal mass spectrometer of claim 25 including said ion trajectory volume being composed of a low vapor pressure polymer.

27. The cycloidal mass spectrometer of claim 2 comprising said housing having a plurality of electrically conductive field plates, and a vacuum enclosure having said housing disposed therein.

28. The cycloidal mass spectrometer of claim 27 including said electrically conductive field plates being composed of stainless steel, and electrically insulative separator means interposed between adjacent pairs of said plates.

29. The cycloidal mass spectrometer of claim 28 including said vacuum enclosure being composed of stainless steel and being electrically insulated from said electrically conductive steel plates.

30. The cycloidal mass spectrometer of claim 28 including said electrically conductive field plates having negative plates and positive plates.

31. The cycloidal mass spectrometer of claim 30 further including rod means securing said field plates in relative spaced insulated relationship with respect to adjacent said plates.

32. The cycloidal mass spectrometer of claim 28 further including resistor means operatively associated with said field plates.

33. The cycloidal mass spectrometer of claim 32 including said resistor means serving to distribute individual plate potentials to said field plates.

34. A cycloidal mass spectrometer comprising, a housing defining an ion trajectory volume, magnetic field generating means for establishing a magnetic field within said ion trajectory volume, ionizer means for receiving a gaseous specimen to be analyzed and converting the gaseous specimen into ions which are discharged therefrom, collection means for simultaneously receiving a plurality of ions of different mass to charge ratios with the position of the ion impingement on said collector means being related to the ion mass, processing means responsive to said collection means for determining the mass distribution of said ions, said ionizer means discharging said ions in such a manner as to cause the ions to travel through said ion trajectory volume to said collection means, said housing having a plurality of electric field plates which define at least a portion of said ion trajectory volume, adjacent said plates being sealingly joined to each other, and said electric field plates being composed of ceramic material having an electrically conductive coating on the surfaces facing said ion trajectory volume.

35. The cycloidal mass spectrometer of claim 34 including said ceramic material being a high density alumina.

36. The cycloidal mass spectrometer of claim 35 including said electrically conductive material being selected from the group consisting of molybdenum, molybdenum-manganese, nickel and copper.

37. The cycloidal mass spectrometer of claim 36 including said ion trajectory volume having an interior length of about 1.5 to 2.0 inch, an interior width of about 0.3 to 0.7 inch and interior height in the region of the collector means of about 0.6 to 1.5 inch.

38. The cycloidal mass spectrometer of claim 37 including said ionizer means having an exterior length of about 3/16 to ½ inch, and an exterior width of about 1/16 to 3/16 inch and an exterior height of about 3/16 to 5/16 inch.

39. The cycloidal mass spectrometer of claim 34 including said field plates having electrically conductive coating on the upper and lower surfaces thereof, and said electrically conductive coating on said surfaces facing said ion trajectory volume having a circumferential gap therein.

40. The cycloidal mass spectrometer of claim 39 including, said electrically conductive coatings on said surfaces facing said ion trajectory volume being circumferentially continuous except for said gap.

41. A cycloidal mass spectrometer comprising, a housing defining an ion trajectory volume, magnetic field generating means for establishing a magnetic field within said ion trajectory volume, ionizer means for receiving a gaseous specimen to be analyzed and converting the gaseous specimen into ions which are discharged therefrom, collection means for simultaneously receiving a plurality of ions of different mass to charge ratios with the position of the ion impingement on said collector means being related to the ion mass, processing means responsive to said collection means for determining the mass distribution of said ions, said ionizer means discharging said ions in such a manner as to cause the ions to travel through said ion trajectory volume to said collection means, said housing having a plurality of electric field plates which define at at least a portion of said ion trajectory volume, adjacent said plates being sealingly joined to each other, and said electric field plates including an upper generally rectangular filament plate, an adjacent underlying ionizer plate having a recess receiving said ionizer and an apertured plate and a collector plate underlying said ionizer plate.

42. The cycloidal mass spectrometer of claim 41 including said filament plate, said ionizer plate and said collector plate, each being generally rectangular and having an elongated inner recess.

43. The cycloidal mass spectrometer of claim 42 including said ionizer means being disposed in a longitudinal position within said ionizer plate spaced from the ends of the recess in said ionizer plate.

44. The cycloidal mass spectrometer of claim 43 including a collector disposed within the recess of said collector plate in a position longitudinally offset from the position of said ionizer means in said ionizer plate.

45. The cycloidal mass spectrometer of claim 44 including said ionizer means having an injector plate having an ion discharge slit disposed on the lower end thereof.

46. A cycloidal mass spectrometer comprising, a housing defining an ion trajectory volume, magnetic field generating means for establishing a magnetic field within said ion trajectory volume, ionizer means for receiving a gaseous specimen to be analyzed and converting the gaseous specimen into ions which are discharged therefrom, collection means for simultaneously receiving a plurality of ions of different mass to charge ratios with the position of the ion impingement on said collector means being related to the ion mass, processing means responsive to said collection means for determining the mass distribution of said ions, said ionizer means having an ion volume block provided with a gas inlet opening for introducing the gaseous specimen into said volume, filament means, and an apertured injector plate, said filament means having a wire filament, said ion volume being composed of a ceramic material, and said filament means being an electrically conductive material coated on the interior surface of said ion volume block.

47. The cycloidal mass spectrometer of claim 46 including said injector plate being composed of electrically conductive material and having an ion discharge opening.

48. The cycloidal mass spectrometer of claim 47 including said gas inlet opening disposed on a wall of said ion volume block generally opposed to said wire filament.

49. Ionizer means structured to be received within a cycloidal mass spectrometer housing comprising, an ion volume having a gas inlet opening for introducing a gaseous specimen into said volume and filament means, said ion volume having ionizer volume block composed of a ceramic material, and said ionizer means having an exterior length of less than about 3/16 to ½ inch.

50. The ionizer means of claim 49 including said filament means having a wire filament.

51. The ionizer means of claim 50 including said ion volume having an injector plate.

52. The ionizer means of claim 51 including said injector plate having a discharge opening which is an elongated slit.

53. The ionizer means of claim 52 including said gas inlet opening being disposed at one end of said ionizer means and said filament means being disposed adjacent to the other end of said ionizer means.

54. The ionizer means of claim 52 including said ion volume having a body portion and two endwalls, and said body portion is generally channel shaped.

55. The ionizer means of claim 54 including said ionizer means having an injector plate cooperating with said endwalls and said body portion to define an ionizer chamber.

56. The ionizer means of claim 52 including said ionizer means having an exterior width of about 1/16 to 3/16 inch and an exterior height of about 3/16 to 5/16 inch.

57. Ionizer means comprising, an ion volume having a gas inlet opening for introducing a gaseous specimen into said volume and filament means, said ion volume having ionizer volume block composed of a ceramic material, said ionizer means having an exterior length of less than about 3/16 to ½ inch, and said filament means being an electrically conductive coating on the interior of said ionizer volume.

58. Ionizer means comprising, an ion volume having a gas inlet opening for introducing a gaseous specimen into said volume and filament means, said ion volume having an ionizer volume block composed of a ceramic material, said ionizer means having an exterior length of less than about 3/16 to ½ inch, said filament means having a wire filament, said ion volume having an injector plate, said injector plate having a discharge opening, said gas inlet opening being disposed at one end of said ionizer means and said filament means being disposed adjacent to the other end of said ionizer means, and said injector plate opening is disposed at a position along the length of said ionizer volume block between said gas inlet opening and said filament means.

* * * * *